US006668504B2

(12) United States Patent
Hughart

(10) Patent No.: US 6,668,504 B2
(45) Date of Patent: Dec. 30, 2003

(54) SOUND-DEADENED WALL AND WALL PANEL FOR SAME

(75) Inventor: Jeffrey S. Hughart, Northfield, IL (US)

(73) Assignee: Knight-Celotex, L.L.C., Northfield, IL (US)

( * ) Notice: Subject to any disclaimer, the term of this patent is extended or adjusted under 35 U.S.C. 154(b) by 27 days.

(21) Appl. No.: 10/121,090

(22) Filed: Apr. 11, 2002

(65) Prior Publication Data

US 2003/0192279 A1 Oct. 16, 2003

(51) Int. Cl.[7] ..... E04C 2/34

(52) U.S. Cl. ..... 52/481.1; 52/481.2; 52/144; 181/284; 181/294

(58) Field of Search ..... 52/144, 481.2, 52/481.1; 181/284, 290, 293, 294

(56) References Cited

U.S. PATENT DOCUMENTS

| | | | | | |
|---|---|---|---|---|---|
| 2,121,962 | A | * | 6/1938 | Glass | 52/144 X |
| 3,090,164 | A | * | 5/1963 | Nelsson | 52/483.1 X |
| 3,324,615 | A | * | 6/1967 | Zinn | 52/481.1 X |
| 3,611,653 | A | * | 10/1971 | Zinn | 52/481.1 X |
| 3,863,412 | A | * | 2/1975 | Bodycomb et al. | 52/481.2 |
| 4,041,667 | A | * | 8/1977 | Lindner et al. | 52/481.2 |
| 4,079,553 | A | * | 3/1978 | Kirk, Jr. | 52/241 X |
| 5,749,187 | A | * | 5/1998 | Umehara et al. | 52/481.1 X |
| 5,787,651 | A | * | 8/1998 | Horn et al. | 52/144 |
| 6,006,484 | A | * | 12/1999 | Geissbuhler | 52/481.1 |
| 6,266,936 | B1 | * | 7/2001 | Gelin | 52/481.1 |
| 6,418,689 | B1 | * | 7/2002 | Hacquard et al. | 52/481.1 X |
| 2002/0092703 | A1 | * | 7/2002 | Gelin et al. | 181/284 X |
| 2003/0070367 | A1 | * | 4/2003 | Gelin et al. | 52/144 |

* cited by examiner

*Primary Examiner*—Carl D. Friedman
*Assistant Examiner*—Nahid Amiri
(74) *Attorney, Agent, or Firm*—Wood, Phillips, Katz, Clark & Mortimer

(57) ABSTRACT

In a sound-deadened wall comprising wooden studs, each of which has a front edge and a back edge, a front wall panel is fastened to the front edges of the studs and a back wall panel is fastened to the back edges of the studs. Further, front spacers are positioned along the front edge of each stud, between the front edge of said stud and the front wall panel, so as to define air gaps between the front edge of said stud and the front wall panel, and back spacers are positioned along the back edge of each stud, between the back edge of said stud and the back wall panel, so as to define air gaps between the back edge of said stud and the back wall panel. Each wall panel has two expansive surfaces and the associated spacers are defined by elastomeric strips adhering to such wall panel, on the expansive face to face the associated edges of the studs, before such wall panel is fastened to the associated edges of the studs. Screws are driven through the wall panels, through the elastomeric strips, into the studs to fasten the wall panels to the studs.

6 Claims, 1 Drawing Sheet

SOUND-DEADENED WALL AND WALL PANEL FOR SAME

FIELD OF THE INVENTION

This invention pertains to a sound-deadened wall and to a wall panel, such as a panel of gypsum drywall board or of fiberboard, for a sound-deadened wall. This invention contemplates that, in a sound-deadened wall embodying this invention, spacers define air gaps between studs and the wall panel.

BACKGROUND OF THE INVENTION

Commonly, in residential and commercial construction, interior walls are constructed with vertical wooden or steel studs, to which gypsum drywall or fiberboard panels are fastened, as by screws driven through the panels into the studs. Sounds tend to be easily transmitted through such walls, as from one room to another, unless such walls are insulated sufficiently with sound-deadening insulation, such as fiberglass mats.

SUMMARY OF THE INVENTION

This invention provides a sound-deadened wall, which does not require sound-deadening insulation. Broadly, the sound-deadened wall comprises studs, a wall panel fastened to the studs, and spacers positioned along each stud, between said stud and the wall panel, so as to define air gaps between said stud and the wall panel. This invention is useful whether the studs are wooden or steel and whether the wall panel is a panel of gypsum drywall or of fiberboard.

Preferably, in a sound-deadened wall embodying this invention, the spacers are elastomeric. Moreover, the spacers may be advantageously defined by elastomeric strips adhering to the wall panel, on the expansive surface to face the studs, before the wall panel is fastened to the studs. Preferably, the wall panel is fastened to the studs by fasteners driven through the wall panel, through the spacers, into the studs. The fasteners may be screws or, if the studs are wooden, the fasteners may be staples, ring-shanked nails, or other nails.

In a preferred embodiment, in which each stud has a front edge and a back edge, a front wall panel is fastened to the front edges of the studs with front spacers positioned along each stud, between said stud and the front wall panel, so as to define air gaps between said stud and the wall panel. Moreover, a back wall panel is fastened to the back edges of the studs with back spacers positioned along each stud, between said stud and the back wall panel, so as to define air gaps between said stud and the wall panel.

This invention also provides a wall panel, which is useful in a sound-deadening wall, as described above. The wall panel, which has two expansive surfaces and which is fastenable to studs, has spacers adhering to a selected one of the expansive surfaces. The spacers are adapted to define air gaps between the studs and the wall panel when the wall panel is fastened to the studs.

Preferably, in a wall panel embodying this invention, the spacers are elastomeric. Moreover, the spacers may be advantageously defined by elastomeric strips adhering to the wall panel, on the expansive surface to face the studs, before the wall panel is fastened to the studs.

DETAILED DESCRIPTION OF THE ILLUSTRATED EMBODIMENT

Figure 1:
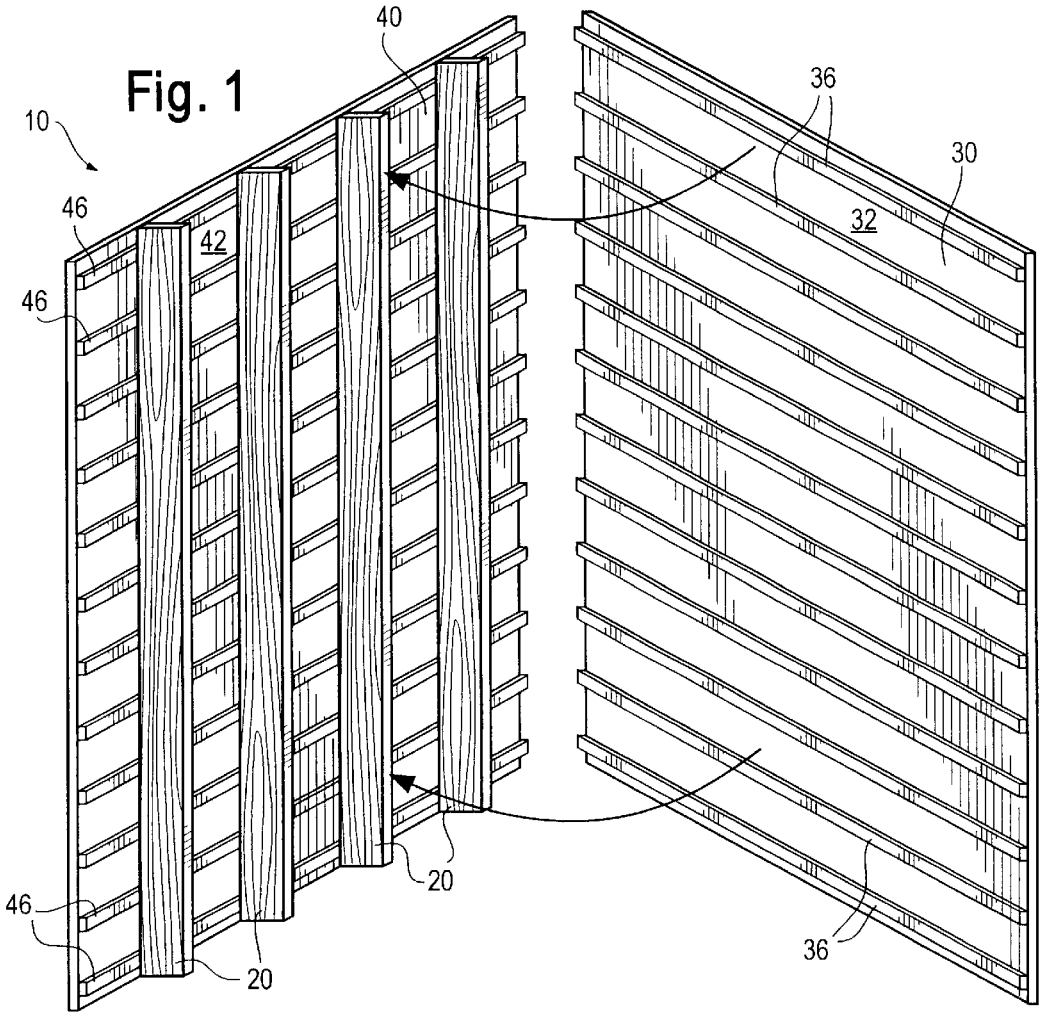
FIG. 1 is a fragmentary, partially exploded view of a wall panel having elastomeric strips defining spacers, as discussed above, and being fastened to studs so as to provide a sound-deadened wall embodying this invention.
Figure 2:
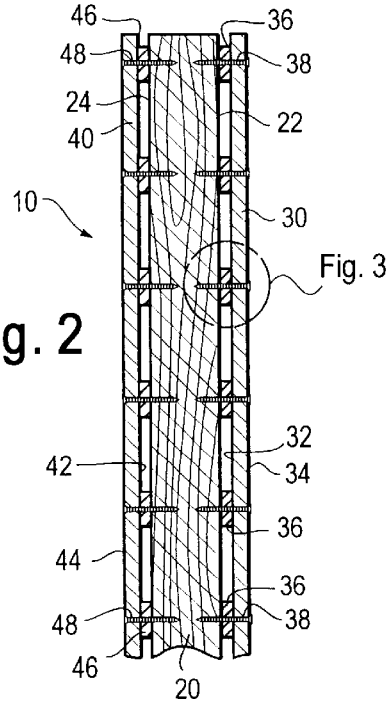
FIG. 2 is a cross-section of the sound-deadened wall, which has a front wall panel and a back wall panel, as discussed above.
Figure 3:
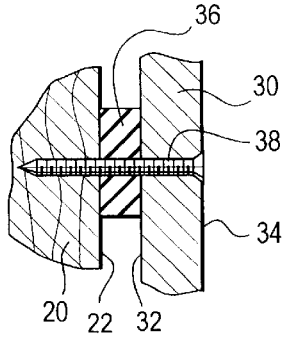
FIG. 3 is an enlarged detail, as taken in a region delineated by a broken-line circle in FIG. 2.

As illustrated, a sound-deadened wall 10 embodying this invention is constructed from an array of wooden studs 20 extending vertically, a front wall panel 30 fastened to the studs 20, and a back wall panel 40 fastened to the studs 20. Each stud 20 has a front edge 22 and a back edge 24. The respective wall panels 30, 40, are similar and are fastened to the studs 20 similarly.

The front wall panel 30, which has two expansive surfaces 32, 34, has an array of elastomeric strips 36 extending horizontally and adhering to the expansive surface 32 that faces the front edges 22 when the front wall panel 30 is fastened to the studs 20. The front wall panel 30 is fastened to the studs 20, at the front edges 22, via screws 38 driven through the front wall panel 30, through the elastomeric strips 36, into the studs 20. The elastomeric strips 36 define air gaps between the studs 20 and the front wall panel 30.

The back wall panel 40, which has two expansive surfaces 42, 44, has an array of elastomeric strips 46 extending horizontally and adhering to the expansive surface 42 that faces the back edges 24 when the back wall panel 40 is fastened to the studs 20 at the back edges 24. The back wall panel 40 is fastened to the studs 20, at the back edges 24, via screws 48 driven through the back wall panel 40, through the elastomeric strips 46, into the studs 20. The elastomeric strips 46 define air gaps between the studs 20 and the back wall panel 40.

Each wall panel 30, 40, may be a panel of gypsum drywall or of fiberboard, which is preferred. The elastomeric strips 36, 46, are similar and may be made of a synthetic rubber, such as neoprene, of a polymeric foam, such as polyurethane foam, or of an elastomeric polymer, such as polyvinyl chloride having a hardness of Durometer 92 Shore A. Any suitable adhesive is used to cause the elastomeric strips 36, 46, to adhere to the respective wall panels 30, 40. Alternatively, but less desirably, non-elastomeric spacers are used.

Air gaps defined by the elastomeric strips 36, between the studs 20 and the front wall panel 30, and air gaps defined by the elastomeric strips 46, between the studs 20 and the back wall panel 40, tend to muffle sounds that would be easily transmitted between the respective wall panels 30, 40, if the respective wall panels 30, 40, were to contact the studs 20 directly.

What is claimed is:

1. A sound-deadened wall comprising wall studs, a wall panel fastened to the studs, elastomeric spacers adhering to the wall panel between said studs and the wall panel and being oriented so as to cross the studs and to define air gaps between said studs and the wall panel, and wherein the wall panel is fastened to the studs by fasteners driven through the wall panel, through the spacers, into the studs.

2. The sound-deadened wall of claim 1 wherein the wall panel has two expansive surfaces and wherein the elastomeric spacers are defined by strips adhering to the wall panel, on the expansive face to face the studs, before the wall panel is fastened to the studs.

3. A sound-deadened wall comprising wall studs, each stud having a front edge and a back edge, a front wall panel fastened to the front edges of the studs and a back wall panel fastened to the back edges of the studs, front elastomeric spacers adhering to the front wall panel between the front edge of said studs and the front wall panel, and being oriented so as to cross the studs and to define air gaps between the front edge of said stud studs and the front wall panel, wherein the front wall panel is fastened to the studs by fasteners driven through the front wall panel, through the front spacers, into the studs, and back elastomeric spacers adhering to the back wall panel between the back edge of said studs and the back wall panel, oriented so as to cross the studs and to define air gaps between the back edge of said stud and the back wall panel, wherein the back wall panel is fastened to the studs by fasteners driven through the back wall panel, through the back spacers, into the studs.

4. The sound-deadened wall of claim 3 wherein the front wall panel has two expansive surfaces and wherein the front elastomeric spacers are defined by snips adhering to the front wall panel, on the expansive face to face the front edges of the studs, before the wall panel is fastened to the front edges of the studs and wherein the back wall panel has two expansive surfaces and wherein the back elastomeric spacers are defined by strips adhering to the back wall panel, on the expansive face to face the back edges of the studs, before the back wall panel is fastened to the back edges of the studs.

5. A wall panel, which has two expansive surfaces, which is fastenable to studs, and which has elastomeric spacers adhering to a selected one of the expansive surfaces, the elastomeric spacers and being oriented so as to cross the studs and define air gaps between the studs and the wall panel when the wall panel is fastened to the studs, wherein the wall panel is fastened to the studs by fasteners driven through the wall panel, through the elastomeric spacers, into the studs.

6. The wall panel of claim 5 wherein the elastomeric spacers are defined by strips adhering to the selected one of the expansive surfaces.

* * * * *